US007946448B1

(12) United States Patent
Madey

(10) Patent No.: US 7,946,448 B1
(45) Date of Patent: May 24, 2011

(54) PILL DISPENSER

(76) Inventor: John Madey, Jupiter, FL (US)

( * ) Notice: Subject to any disclaimer, the term of this patent is extended or adjusted under 35 U.S.C. 154(b) by 0 days.

(21) Appl. No.: 12/351,494

(22) Filed: Jan. 9, 2009

Related U.S. Application Data

(60) Provisional application No. 61/101,279, filed on Sep. 30, 2008.

(51) Int. Cl.
*G07F 11/66* (2006.01)
*G07F 11/72* (2006.01)

(52) U.S. Cl. ..... 221/25; 221/26; 221/30; 221/31; 221/131; 414/412; 206/531

(58) Field of Classification Search ..... 221/26, 221/225, 25, 30, 31, 131; 414/412
See application file for complete search history.

(56) References Cited

U.S. PATENT DOCUMENTS

| | | | | |
|---|---|---|---|---|
| 3,324,996 | A | 6/1967 | Jordt | |
| 4,074,806 | A | 2/1978 | Ardito | |
| 4,158,411 | A | 6/1979 | Hall et al. | |
| 4,384,649 | A | 5/1983 | Brodsky | |
| 5,019,125 | A | 5/1991 | Rebne et al. | |
| 5,358,118 | A | 10/1994 | Thompson et al. | |
| 5,368,187 | A | 11/1994 | Poncetta et al. | |
| 5,405,011 | A | 4/1995 | Haber et al. | |
| 5,431,283 | A * | 7/1995 | Weinstein et al. | 206/531 |
| 5,472,115 | A * | 12/1995 | Whiton | 221/25 |
| 5,613,609 | A | 3/1997 | Hamilton et al. | |
| 5,722,563 | A * | 3/1998 | Hunts | 221/25 |
| 5,791,513 | A * | 8/1998 | Intini | 221/30 |
| 5,974,929 | A * | 11/1999 | Kugel et al. | 83/582 |
| 5,988,429 | A | 11/1999 | Coe | |
| 6,082,544 | A | 7/2000 | Romick | |
| 6,098,835 | A | 8/2000 | DeJonge | |
| 6,149,029 | A | 11/2000 | de Meyer et al. | |
| 6,155,454 | A | 12/2000 | George et al. | |
| 6,193,103 | B1 | 2/2001 | Clarijs | |
| 6,206,233 | B1 | 3/2001 | Schulze | |
| 6,338,408 | B1 | 1/2002 | Anderson | |
| 6,557,740 | B1 * | 5/2003 | Dent | 225/104 |
| 6,726,053 | B1 | 4/2004 | Harrold | |
| 7,051,898 | B1 | 5/2006 | Connell | |
| 7,093,736 | B2 | 8/2006 | Maietta et al. | |
| 7,104,417 | B2 | 9/2006 | Hilliard | |
| 7,175,044 | B2 | 2/2007 | Benktzon et al. | |
| 7,198,173 | B2 | 4/2007 | Simon | |
| 7,231,920 | B2 | 6/2007 | Harvey et al. | |
| 7,252,208 | B1 | 8/2007 | Alvino et al. | |

(Continued)

*Primary Examiner* — Gene O. Crawford
*Assistant Examiner* — Rakesh Kumar
(74) *Attorney, Agent, or Firm* — Gold & Rizvi, P.A.; Glenn E. Gold; H. John Rizvi

(57) ABSTRACT

A pill dispenser is provided for removing a pill from a blister pack having one or more foil sealed compartments in a plastic sheet, each containing a single pill. The pill dispenser includes a generally planar stage in generally horizontal orientation, a press assembly and a post. An opening is provided in the stage. The post extends upward, from the stage and the press assembly is rotatably coupled to the post. The press assembly includes a punch, configured such that the press assembly may be rotated to advance the punch through the opening. The blister pack may be loaded on the stage, with a compartment aligned with the opening and the foil adjacent to the stage. The press assembly may be operated to collapse the compartment, rupture the foil, and force the pill through the opening. A tray may be provided below the stage, for catching the pill.

8 Claims, 5 Drawing Sheets

U.S. PATENT DOCUMENTS

| | | | | |
|---|---|---|---|---|
| 7,264,136 | B2 | 9/2007 | Willoughby et al. | |
| 7,264,137 | B2 * | 9/2007 | Drought et al. | 221/25 |
| 7,284,661 | B1 | 10/2007 | Evans et al. | |
| 7,562,790 | B2 * | 7/2009 | Wheeler et al. | 221/31 |
| 2003/0006163 | A1 | 1/2003 | Patterson | |
| 2003/0029880 | A1 * | 2/2003 | Hunts | 221/25 |
| 2003/0034271 | A1 | 2/2003 | Burridge | |
| 2004/0040881 | A1 | 3/2004 | Grosskopf | |
| 2004/0079759 | A1 | 4/2004 | Harrold | |
| 2004/0129717 | A1 | 7/2004 | Gauthier et al. | |
| 2004/0188313 | A1 | 9/2004 | Tedham | |
| 2005/0082194 | A1 | 4/2005 | Fry et al. | |
| 2005/0252924 | A1 | 11/2005 | Pieper et al. | |
| 2005/0274643 | A1 | 12/2005 | Arnold | |
| 2006/0102512 | A1 | 5/2006 | Lo Duca | |
| 2006/0151514 | A1 * | 7/2006 | Drought et al. | 221/25 |
| 2007/0062840 | A1 | 3/2007 | Elliot | |
| 2007/0138049 | A1 | 6/2007 | Bitner | |
| 2007/0267318 | A1 | 11/2007 | Grosskoft | |

* cited by examiner

PILL DISPENSER

CROSS-REFERENCE TO RELATED APPLICATION

Applicant claims the benefit of co-pending U.S. Provisional Patent Application Ser. No. 61/101,279, filed on Sep. 30, 2008, by the present inventor, which is incorporated herein its entirety.

BACKGROUND OF THE INVENTION

1. Field of the Invention

The present invention relates generally to pill dispensers and more particularly to a pill dispenser for dispensing a pill from a blister pack to a collector.

2. Description of the Prior Art

Many medications are produced in discreet units, in the form of pills or capsules, to be taken orally. Each unit is manufactured so as to contain an exact measured dosage. A patient may maintain correct and consistent dosage by taking a prescribed course of uniform units according to a planned schedule. Units of medication in the form of pills and capsules, collectively referred to as pills, are typically packaged and delivered loose in a relatively small container, such as a bottle or a canister. A patient usually opens the container, dispenses a number of pills into a palm, manipulates the pills to retain, in the palm, a number of pills corresponding to the scheduled dosage, and tips the remaining pills back into the container. This practice causes repeated handling of the pills and often leads to spilling and/or losing of a number of pills.

In order to avoid the potential for mishaps when dispensing pills from a container, pharmaceutical suppliers have developed the blister pack. The blister pack comprises a sheet of plastic having an array of spaced apart blisters protruding from an obverse surface of the sheet. Each blister is open to a reverse surface of the sheet and serves as a separate compartment. A single pill is deposited in each compartment and a sheet of metal foil is affixed to the reverse surface of the sheet, closing the compartments, and separately sealing each pill. When a pill is needed, a patient may select a particular compartment, press the blister to collapse the compartment, rupturing the foil, and releasing the pill. Unused pills remain sealed in the compartments of the blister pack, until they are removed for use. The blister pack avoids the potential for spilling a number of pills during the process of removing a single dose of medication. In addition, the blister pack facilitates tracking the number of pills previously administered, because a patient may count the number of opened compartments. Also, sanitary conditions are improved because the supply of pills is not handled repeatedly.

Unfortunately, the process of pressing a compartment and retrieving a pill as it passes through the foil on the reverse side of the blister pack is difficult, particularly for elderly patients, who may have impaired vision and reduced manual dexterity. There is a need for a device, which can dispense a pill from a blister pack reliably and which can deposit the pill into a collector from which the pill may be easily retrieved. There is a need for a pill dispenser, which is compact and manually operated, to deliver a single pill from a blister pack to a collector.

SUMMARY OF THE INVENTION

The present invention is directed to a pill dispenser for delivering a pill from a blister pack, for use by a patient. A blister pack includes a plurality of compartments arranged on a sheet of plastic, each of the compartments containing a single pill and being open to a reverse surface. Compartments are sealed by frangible metal foil. The pill dispenser of the present invention comprises a stage, a press assembly, and connecting means. The stage is provided with a passage means. The press assembly is rotatably coupled to the stage by the connecting means and includes a punch, having a distal tip. The press assembly is configured for rotating the tip into the passage means. The patient may load the blister pack to the dispenser with the foil seal adjacent to the stage and with a pill containing compartment aligned with the passage means. The press assembly may be manually manipulated to rotate the tip into the passage means for forcing the pill through the foil seal and through the passage means.

The passage means may comprise an opening in the stage and an adapter selected from a group of adapters having holes of graduated sizes and shapes, for passing pills of corresponding sizes and shapes. The opening is provided with a perimeter ledge designed to receive and support an adapter in snug fitting engagement, the patient having selected an adapter having a hole of appropriate size and shape for passing a pill contained in the blister pack, from adapters in the group. The adapter may be disposed on the ledge and the dispenser may be operated to deliver a pill through the hole in the adapter. The hole in the adapter being intended to restrict the opening in the stage to an area slightly greater than the profile of the pill, so as to concentrate the force of the tip on the portion of the foil seal adjacent to the pill.

The pill dispenser may also include a collector which may be placed adjacent to the stage for receiving the pill from the passage means, for conveniently collecting one or more pills comprising a scheduled dosage of medication.

It is an object of the present invention to provide a device which can reliably dispense a pill from a blister pack into a collector, from which the pill may be easily retrieved.

It is a further object of the present invention to provide a compact and manually operated device which can quickly and conveniently dispense a pill from a blister pack to a collector.

These and other objects, features and advantages of the present invention will become more readily apparent from the attached drawings and the detailed description of the preferred embodiments, which follow.

BRIEF DESCRIPTION OF THE DRAWINGS

The invention will be further understood, by way of example, with reference to the accompanying drawings, in which.

DETAILED DESCRIPTION OF THE PREFERRED EMBODIMENTS

Figure 1:
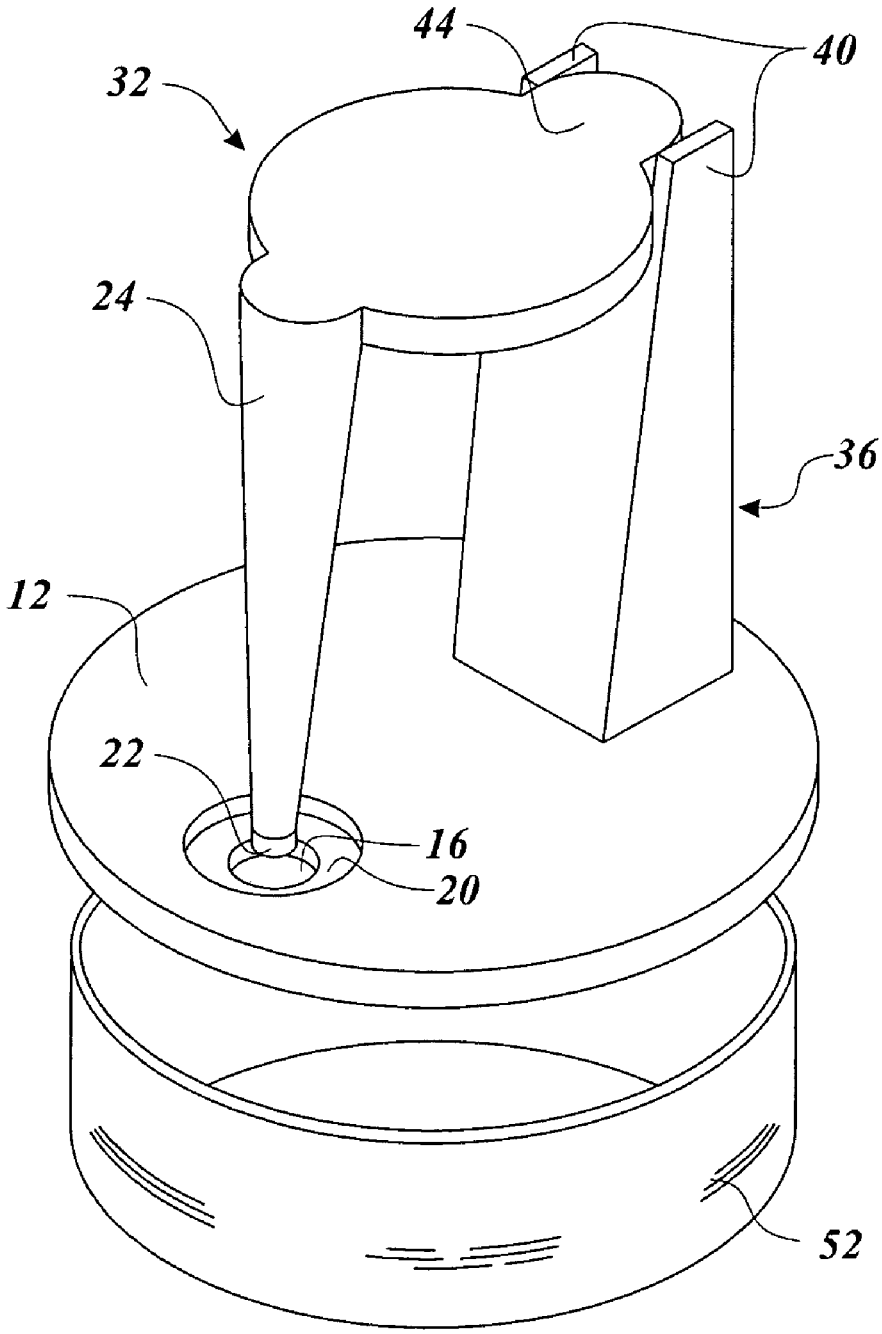
FIG. 1 is a perspective view of the pill dispenser of the present invention.
Figure 2:
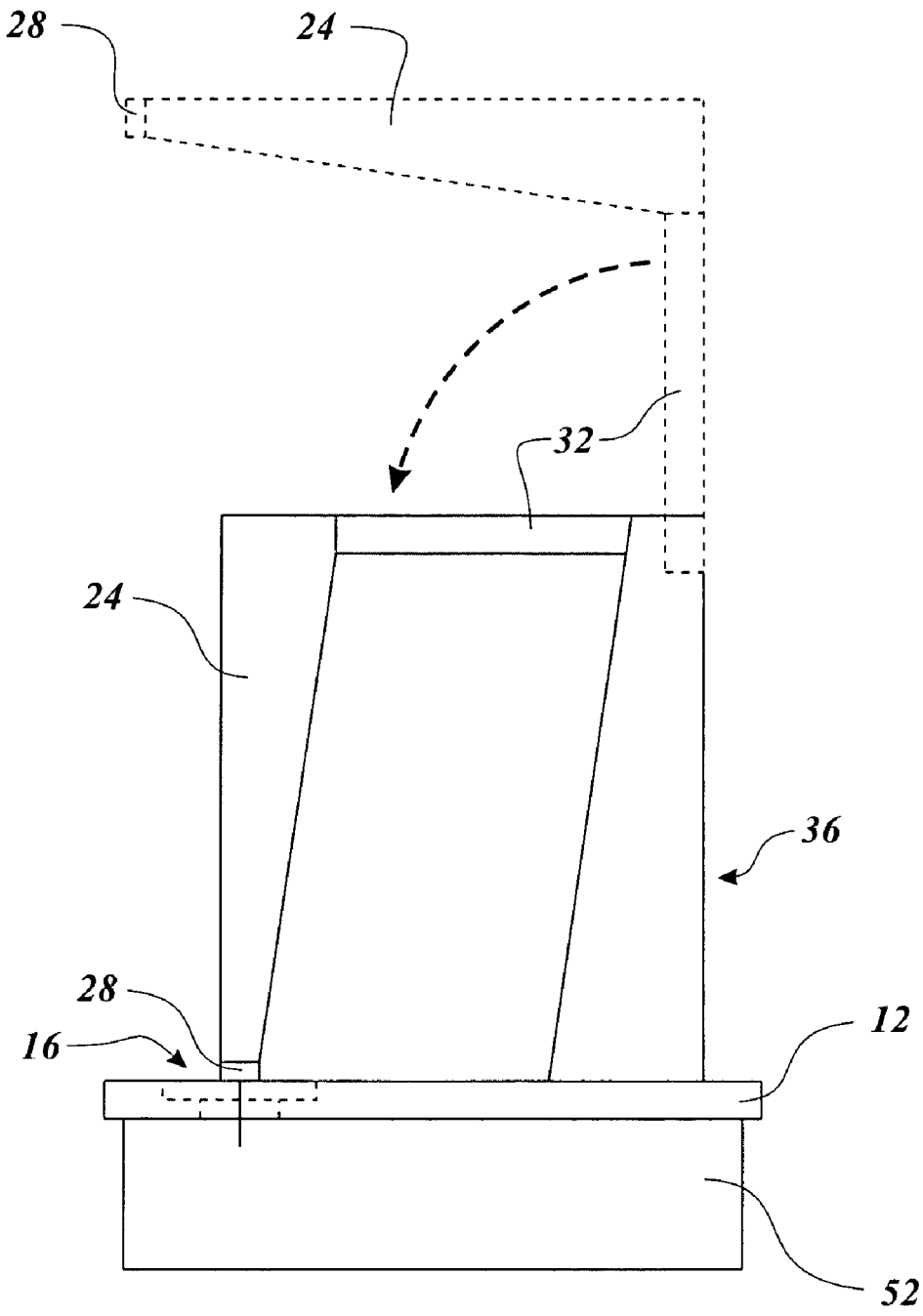
FIG. 2 is an elevation view of the pill dispenser of the present invention showing the rotation of the press assembly.

Shown throughout the drawings, the present invention is a pill dispenser for delivering a pill from a blister pack to a collector. The pill dispenser, shown in FIG. 1, includes a stage 12, a press assembly, and connecting means. The stage 12 is preferably generally planar and horizontally oriented. The stage 12 is provided with a passage means. The passage means preferably includes an opening 16 in the stage 12 having an inside perimeter ledge 20. The press assembly includes a punch 24 having a distal tip 28 and preferably a bridge section 32. The connecting means rotatably couples the press assembly to the stage 12. The connecting means preferably includes a post 36, extending upward from the stage 12 and rotatably supporting the press assembly. The bridge section 32 is preferably interposed between the punch 24 and the post 36. The connecting means includes a pair of spaced apart tabs 40 extending from the post 36 and a projecting tongue 44, on the bridge section 32, which is partially received in the space between the tabs 40. The tongue 44 is rotatably retained by a pair of outwardly extending bosses (not shown), on the tongue 44, which are received in an aligned pair of wells (not shown) provided on facing surfaces of the tabs 40. The punch 24 extends generally downward from the bridge section 32, opposite the tongue 44. The bridge section 32 and the punch 24 are configured such that the tip 28, at the distal end of the punch 24 proceeds through the opening 16 when the press assembly is rotated downward, as shown in FIG. 2. It will be appreciated by those skilled in the art that a variety of structural arrangements may be employed to provide a press assembly rotatably coupled to a stage, in a configuration such that the press assembly may be manipulated to advance a tip of a punch into an opening in a stage. For example, it will be recognized that a punch of curved shape may be rotatably connected directly to a stage, which is not provided with a post and that such a punch may be rotated to advance a distal tip of the punch into an opening in the stage, all within the scope of the present invention.

Figure 3:
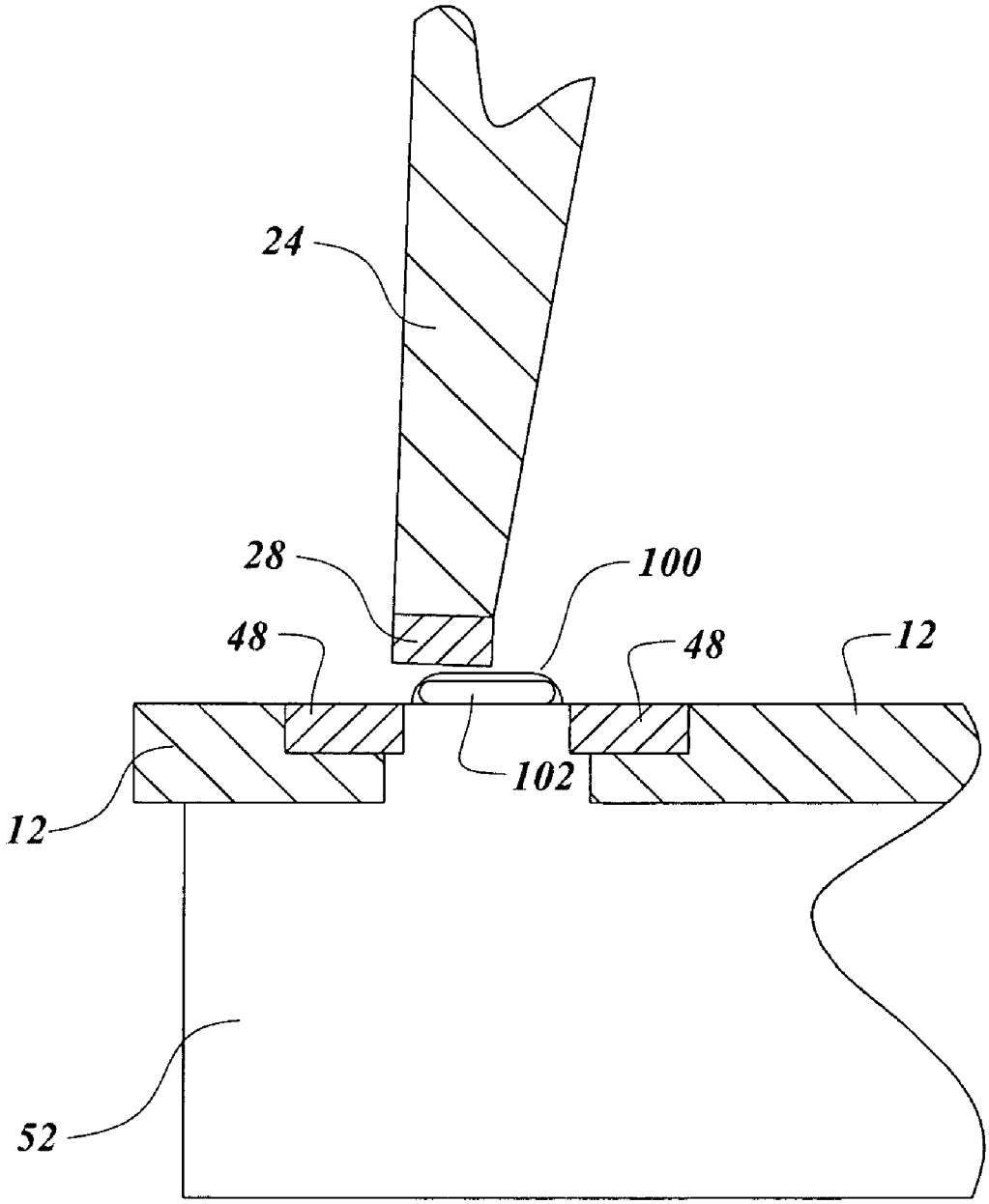
FIG. 3 is a partial cut-away elevation view showing a pill containing blister pack compartment disposed on the stage.
Figure 4:
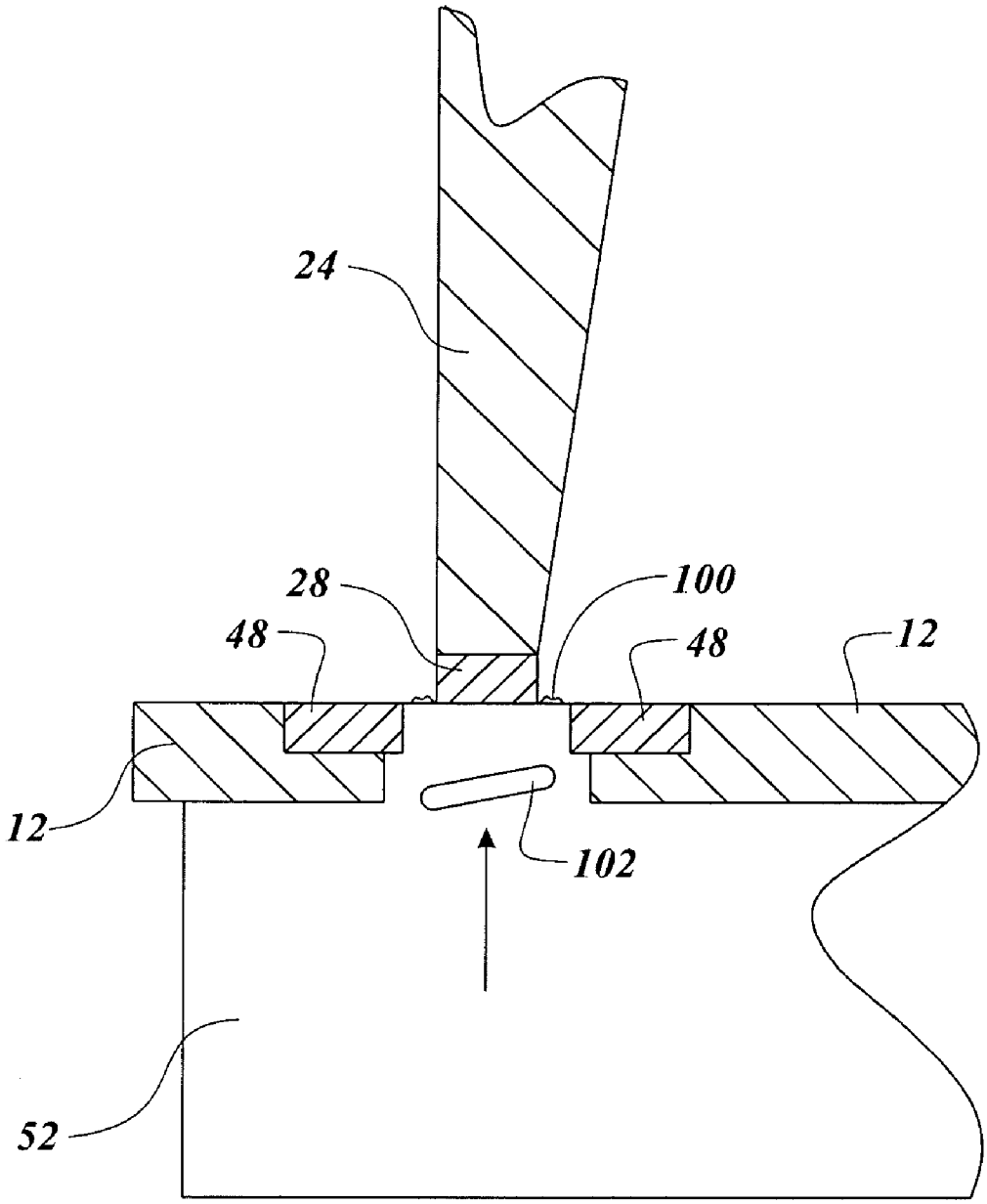
FIG. 4 is a partial cut-away elevation view showing a pill being dispensed through the passage means to the tray.
Figure 5:
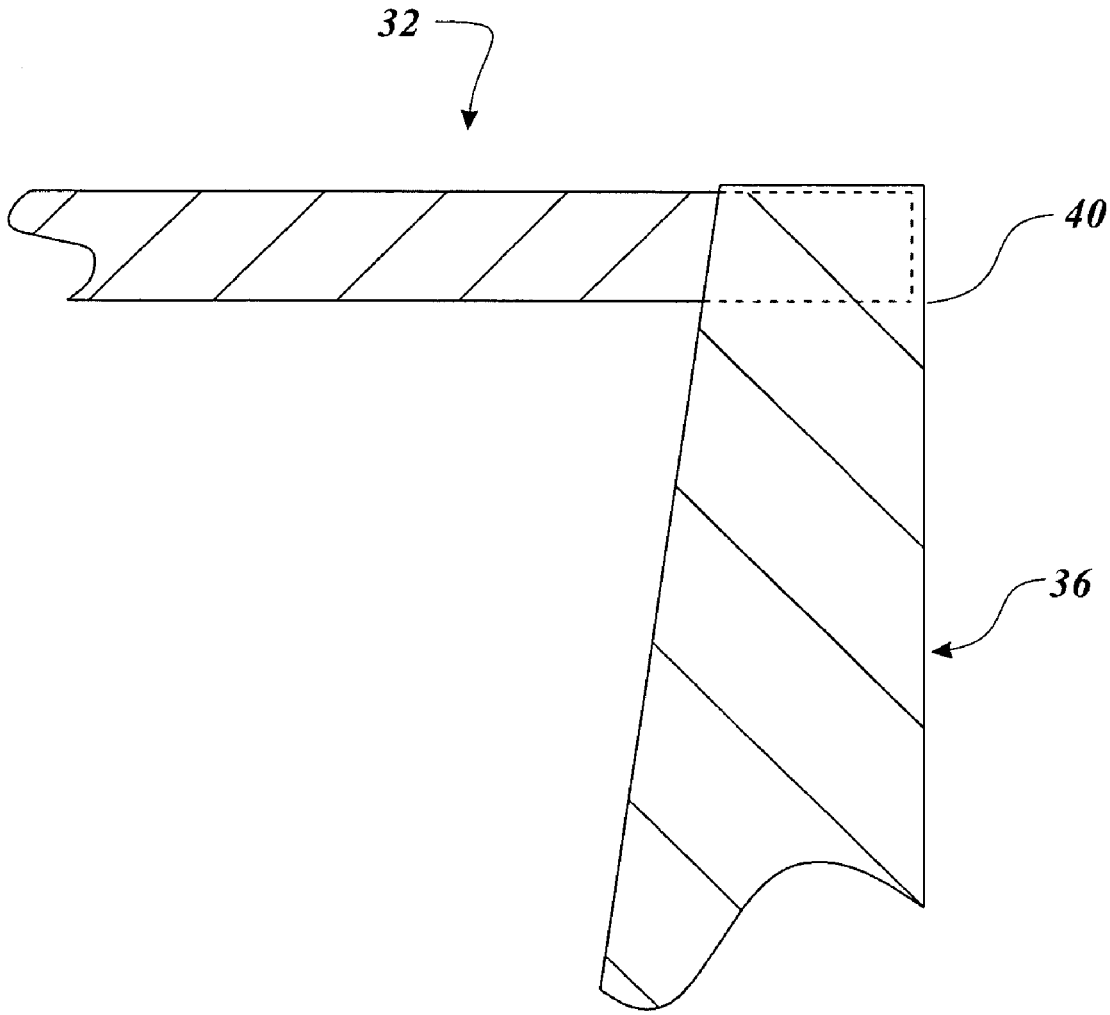
FIG. 5 is a partial elevation view of the bridge section and the post.

It is intended that the pill dispenser of the present invention is suitable for dispensing a pill from a conventional blister pack containing a plurality of pills, each pill being contained in a separate compartment formed as a protruding blister, on an obverse surface of a sheet of plastic. The compartments are sealed, to retain the pills, by a sheet of frangible metal foil applied to a reverse surface of the plastic sheet to close the compartments. The pill dispenser may be used by aligning a compartment, consisting of a blister 100 containing a medication unit 102, which may be a pill or a capsule, with the opening 16 such that the foil is adjacent to the stage 12, as shown in FIG. 3. The press assembly may be rotated downward to advance the tip 28 through the opening 16, as shown in FIG. 4, to collapse the blister 100, rupture the foil, and propel the medication unit 102 through the opening 16. The relative positions of the post 36 and bridge section 32 are sown in FIG. 5. It is preferred that the tip 28 be a cushioned pad formed of foam rubber, fiber matting, or other soft material, to prevent damage to the coating or the gel cap of the medication unit 102. It is also preferred that the passage means of the pill dispenser include an adapter 48 as shown in FIGS. 3 and 4, sized to fit within the opening 16 and rest, in snug fitting engagement, on the ledge 20. The adapter 48 is provided with a hole having a shape complementary to that of the pill to be dispensed and a size slightly larger than the pill such that the force of the tip 28 may be concentrated on the portion of the foil adjacent to the pill, to facilitate the rupture of the foil and release the pill. It is preferred that a group of adapters having holes of various sizes and shapes be provided in a design for interchangeable substitution so that a patient may select an appropriate adapter for insertion on the ledge 20 of the passage means. In an alternate embodiment, an opening, in a stage, may be designed to receive a larger adapter having a plurality of graduated holes in a radial pattern, so that the adapter may be turned to bring a selected hole in alignment with the travel path of the punch 24.

It is also preferred that the pill dispenser include a collector, such as a tray 52, which may be configured for releasable attachment to the underside of the stage 12, to receive and retain the pill, which has passed through the opening 16.

The pill dispenser of the present invention may be operated to deliver a pill to the tray 52 and subsequently another compartment containing a pill may be moved into position in alignment with the opening 16. The pill dispenser may be operated to deliver a second pill to the tray 52. In this manner, the pill dispenser may be used to collect a dosage of one or more pills, in the tray 52 where the pills may be stored or easily removed for administration.

While the preferred embodiments of the invention have been described above, it will be recognized and understood that various modifications can be made in the invention and the appended claims are intended to cover all such modifications which may fall within the spirit and scope of the invention.

What is claimed is:

1. A pill dispenser for removing a pill from a blister pack having a pill containing compartment with a foil seal, said pill dispenser comprising:

a tray adapted to contain pills;

a stage, a press assembly, and connecting means selectively detachably supported by said tray;

said stage having an upper surface provided with a passage means communicating with said tray;

said passage comprising an opening, said opening passing through said stage, and a cavity having an interior perimeter ledge surrounding said opening, said ledge having a uniform depth from said stage upper surface;

said press assembly being rotatably coupled to said stage by said connecting means;

said press assembly including an elongated, tapered punch having a distal tip;

said press assembly being configured for rotating said tip into said passage means;

an adapter having a uniform thickness equal to said ledge uniform depth, the adapter having a peripheral shape and dimension providing snug fitting engagement with said cavity, wherein an adapter upper surface of said adapter is flush with said stage upper surface when said adapter is inserted into said cavity; and said adapter having an adapter aperture extending therethrough, said adapter aperture sized to correspond with said pill, for concentrating the force of the tip onto a portion of the foil adjacent to said pill;

whereby said blister pack may be loaded to said dispenser with said foil adjacent to said stage and with said compartment aligned with said passage means and said press assembly may be manually manipulated to rotate said tip into said passage means for forcing said pill through said foil seal and through said passage means and into said tray.

2. The pill dispenser of claim 1, wherein said connecting means includes a post projecting from said stage for rotatably supporting said press assembly.

3. The pill dispenser of claim 2, wherein said press assembly includes a bridge section interposed between said punch and said post.

4. The pill dispenser of claim 1, wherein said tip comprises a cushioned pad.

5. A pill dispenser for removing a pill from a blister pack having a pill containing compartment with a foil seal, said pill dispenser comprising:

a cylindrical tray having a circular bottom and a circular side wall extending from said circular bottom and terminating at a side wall upper edge;

a circular stage selectively detachably supported by said side wall upper edge of said tray and a press assembly and connecting means supported by said stage;

said stage being provided with an opening having a circular stepped inside perimeter ledge;

an adaptor removably inserted in said opening and seated on said inside perimeter ledge, said adaptor having an upper surface flush with an upper surface of said stage;

said press assembly being rotatably coupled to said stage by said connecting means;

said press assembly including an elongated punch having a proximal end carried by said connecting means and a distal tip tapering from said proximal end;

said press assembly being configured for rotating said tip into said opening;

whereby said blister pack may be loaded to said dispenser with said foil adjacent to said stage and with said compartment aligned with said opening and said press assembly may be manually manipulated to rotate said tip into said opening for forcing said pill through said foil seal and through said opening and into said tray.

6. The pill dispenser of claim 5, wherein said connecting means includes a post projecting from said stage for rotatably supporting said press assembly.

7. The pill dispenser of claim 6, wherein said press assembly includes a bridge section interposed between said punch and said post.

8. A pill dispenser for removing a pill from a blister pack having a pill containing compartment with a foil seal, said pill dispenser comprising:

a cylindrical tray having a circular bottom, a circular side wall extending from said circular bottom and terminating at a side wall upper edge and a tray interior defined by and between said circular bottom and said circular side wall and adapted to contain a plurality of pills;

a circular stage supported by said side wall upper edge of said tray and selectively detachable from said side wall upper edge to expose said tray interior of said tray;

a press assembly and connecting means having an elongated post with a proximal end carried by said stage and a distal end spaced-apart from said proximal end of said post;

said stage being provided with an opening communicating with said tray interior and having a circular stepped inside perimeter ledge;

an adaptor removably inserted in said opening and seated on said inside perimeter ledge, said adaptor having an upper surface flush with an upper surface of said stage;

said press assembly being rotatably coupled to said distal end of said post;

said press assembly including an elongated punch having a proximal end carried by said connecting means and a distal tip tapering from said proximal end;

said press assembly being configured for rotating said tip into said opening;

whereby said blister pack may be loaded to said dispenser with said foil adjacent to said stage and with said compartment aligned with said opening and said press assembly may be manually manipulated to rotate said tip into said opening for forcing said pill through said foil seal and through said opening and into said tray interior of said tray.

* * * * *